US009743163B2

(12) United States Patent
Ito

(10) Patent No.: US 9,743,163 B2
(45) Date of Patent: Aug. 22, 2017

(54) LOUDSPEAKER UNIT

(71) Applicant: Alpine Electronics, Inc., Tokyo (JP)

(72) Inventor: Ryo Ito, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 107 days.

(21) Appl. No.: 14/156,650

(22) Filed: Jan. 16, 2014

(65) Prior Publication Data

US 2014/0270270 A1 Sep. 18, 2014

(30) Foreign Application Priority Data

Mar. 15, 2013 (JP) ..... 2013-053771

(51) Int. Cl.
*H04R 25/00* (2006.01)
*H04R 1/00* (2006.01)
(Continued)

(52) U.S. Cl.
CPC ..... *H04R 1/00* (2013.01); *H04R 1/06* (2013.01); *H04R 1/2842* (2013.01); *H04R 1/345* (2013.01);
(Continued)

(58) Field of Classification Search
CPC .. H04R 2499/13; H04R 2400/11; H04R 9/06; H04R 1/00; H04R 1/2842; H04R 1/345;
(Continued)

(56) References Cited

U.S. PATENT DOCUMENTS 4,969,196 A * 11/1990 Nakamura ..... H04R 1/403 181/152
5,022,488 A * 6/1991 House ..... 181/156
(Continued)

FOREIGN PATENT DOCUMENTS

EP 2620328 7/2013
JP 62-272699 11/1987
(Continued)

OTHER PUBLICATIONS

Extended European Search Report for EP14156794 dated Nov. 19, 2014, 8 pgs.
(Continued)

*Primary Examiner* — Davetta W Goins
*Assistant Examiner* — Phylesha Dabney
(74) *Attorney, Agent, or Firm* — Brinks Gilson & Lione

(57) ABSTRACT

A loudspeaker unit includes a voice coil, a diaphragm, a damper, a frame supporting an outer edge of the diaphragm and an outer edge of the damper, and a duct projecting from an outer surface of the frame, with air moved by vibration of the diaphragm flowing into and out of the loudspeaker unit through the duct. The frame has an aperture that communicates with a space inside the frame. The duct, serving as a separate member, is attached to the frame so as to cover the aperture. The frame further includes a support tab that projects into the aperture. Link terminals are attached to the support tab. Before the duct is attached to the frame, lead wires extending from the voice coil are formed into a predetermined shape and are then connected to the link terminals in a space within the aperture.

12 Claims, 9 Drawing Sheets

(51) Int. Cl.

| | |
|---|---|
| ***H04R 1/06*** | (2006.01) |
| *H04R 9/02* | (2006.01) |
| *H04R 9/06* | (2006.01) |
| *H04R 1/28* | (2006.01) |
| *H04R 1/34* | (2006.01) |

(52) U.S. Cl.
CPC ..... *H04R 9/02* (2013.01); *H04R 9/06* (2013.01); *H04R 2400/11* (2013.01); *H04R 2499/13* (2013.01)

(58) Field of Classification Search
CPC ..... H04R 9/022; H04R 15/00; H04R 1/02; H04R 1/025; H04R 1/06; H04R 1/10; H04R 1/1016; H04R 1/26; H04R 1/2803; H04R 1/2811; H04R 1/2815; H04R 1/2819
USPC ..... 381/345, 86, 386, 349, 350, 389, 394, 381/395, 433; 181/156, 198, 199
See application file for complete search history.

(56) References Cited

U.S. PATENT DOCUMENTS

| | | | | |
|---|---|---|---|---|
| 5,625,699 | A * | 4/1997 | Yamada | 381/99 |
| 5,909,015 | A * | 6/1999 | Yamamoto et al. | 181/156 |
| 6,560,343 | B1 * | 5/2003 | Kim | H04R 5/02 181/156 |
| 8,094,853 | B2 * | 1/2012 | Seki | H04R 1/2826 138/156 |
| 8,708,092 | B2 * | 4/2014 | Ito et al. | 181/156 |
| 8,837,762 | B2 * | 9/2014 | Tada | H04R 9/025 381/337 |
| 2007/0230738 | A1 * | 10/2007 | Royse | H04R 9/025 381/433 |
| 2007/0269075 | A1 * | 11/2007 | Kato | H04R 1/06 381/394 |
| 2012/0219171 | A1 | 8/2012 | Velican | |
| 2013/0188806 | A1 * | 7/2013 | Tada | 381/86 |
| 2013/0272537 | A1 * | 10/2013 | Tada et al. | 381/86 |
| 2014/0270270 | A1 * | 9/2014 | Ito | 381/162 |
| 2014/0334633 | A1 * | 11/2014 | Krueger et al. | 381/71.4 |

FOREIGN PATENT DOCUMENTS

| | | |
|---|---|---|
| JP | 63-043924 | 3/1988 |
| JP | 63-120589 | 5/1988 |
| JP | 63-287296 | 11/1988 |
| JP | 9-298796 | 11/1997 |
| JP | 2002-125292 | 4/2002 |
| JP | 2008-085528 | 4/2008 |
| JP | 2013-509049 | 3/2013 |
| WO | WO2011/047435 | 4/2011 |

OTHER PUBLICATIONS

Notification of Reasons for Refusal for JP2013-053771 dated May 31, 2016, 6 pgs. including English translation.
Office Action for Japanese Patent Application No. 2013-053771 dated Dec. 20, 2016, 5 pgs. Including English translation.

* cited by examiner

LOUDSPEAKER UNIT

RELATED APPLICATION

The present application claims priority to Japanese Patent Application Number 2013-053771, filed Mar. 15, 2013, the entirety of which is hereby incorporated by reference.

BACKGROUND

1. Field of the Invention

The present invention relates to a loudspeaker unit in which a voice coil is energized to vibrate a diaphragm, and in particular, relates to a loudspeaker unit suitable to be installed in a vehicle cabin subject to severe space constraints or a space outside the vehicle cabin, e.g., an engine compartment.

2. Description of the Related Art

FIG. 9 is a cross-sectional view of a typical electrodynamic loudspeaker unit disclosed in, for example, Japanese Unexamined Patent Application Publication No. 62-272699. As illustrated in FIG. 9, a loudspeaker unit 100 includes a magnetic circuit 101 having a magnetic gap G, a voice coil 102 disposed in the magnetic gap G, the voice coil 102 being driven by electromagnetic interaction when energized, a substantially conical diaphragm 103 vibrating in unison with the voice coil 102, an annular damper 104 elastically supporting the voice coil 102 and the diaphragm 103, and a substantially conical frame 105 holding an outer edge of the diaphragm 103 and an outer edge of the damper 104.

The magnetic circuit 101 includes a bottom plate 106 having a center pole 106*a*, a ring-shaped magnet 107 placed on the bottom plate 106, and a top plate 108 disposed on the magnet 107. The magnetic gap G is defined between an outer circumferential surface of the center pole 106*a* and an inner circumferential surface of the top plate 108. The voice coil 102 is wound around a cylindrical bobbin 109. An inner edge of the diaphragm 103 and an inner edge of the damper 104 are bonded and fixed to upper end part of the bobbin 109. The frame 105 is fixed to an upper surface of the top plate 108. The frame 105 has a plurality of openings 105*a* arranged at regular intervals in a circumferential direction. The outer edge of the diaphragm 103 is held by an upper end of the frame 105, with an edge member 110 therebetween. A cap 111 is attached to central part of the diaphragm 103. The outer edge of the damper 104 is held by substantially intermediate part of the frame 105 in a vertical direction in FIG. 9.

A pair of lead wires 112, called tinsel wires, are connected to the voice coil 102. Audio current is supplied through the lead wires 112 to the voice coil 102. The lead wires 112 are routed out of a space between the diaphragm 103 and the damper 104. The tips of the lead wires 112 are connected to link terminals 113 attached to the frame 105. The lead wires 112 have to be in non-contact with the diaphragm 103 and the damper 104 during vibration of the voice coil 102. Such a non-contact state is provided by inserting a jig (not illustrated) into any of the openings 105*a*, forming free end portions of the lead wires 112 into a given shape (curved shape) using the jig, welding the tips of the lead wires 112 to the link terminals 113, and then removing the jig.

Another related-art loudspeaker unit with such a configuration further includes a cylindrical duct disposed so as to project from an outer surface of a conical frame which holds an outer edge of a diaphragm, the duct being allowed to communicate with an opening in a vehicle cabin wall (refer to International Publication No. WO 2011/047435, for example). In this related-art loudspeaker unit, a loudspeaker interior space defined by the diaphragm, a damper, and the frame is adjacent to an open end of the duct. Accordingly, air moved by vibration of the diaphragm flows into and out of the interior space through the duct, so that back pressure can be controlled using the additional mass of the duct (air resistance in the duct).

In the related-art loudspeaker unit disclosed in International Publication No. WO 2011/047435, the back pressure can be controlled such that sound pressure in a low frequency range is increased by appropriately setting the length and the diameter of the duct projecting from the outer surface of the frame. If this loudspeaker unit is a relatively large loudspeaker unit, such as a subwoofer, therefore, it can be installed in a vehicle cabin that is subject to severe space constraints. Since the duct projects from the outer surface of the frame which serves as an enclosure, a rear surface of the diaphragm is fully covered with the frame provided with the duct. Unfortunately, it is difficult to provide a sufficient space to form lead wires extending from a voice coil into a desired shape. In this case, the use of a damper provided with lead wires (tinsel wires) can eliminate forming the lead wires. However, such a damper is very expensive, leading to cost problems. Additionally, in terms of reliability, it is difficult to allow a loudspeaker unit with high drive power, e.g., a subwoofer, to include this damper.

SUMMARY

The present invention has been made in consideration of the above-described circumstances of the related art. It is an object of embodiments of the present invention to provide a loudspeaker unit including a duct, the loudspeaker unit being configured such that a lead wire extending from a voice coil can be easily routed.

An embodiment of the present invention provides a loudspeaker unit including a magnetic circuit having a magnetic gap, a voice coil disposed in the magnetic gap, a diaphragm vibrating in unison with the voice coil, a damper elastically supporting the voice coil and the diaphragm, a frame holding an outer edge of the diaphragm and an outer edge of the damper, and a duct projecting from the frame, with air moved by vibration of the diaphragm flowing into and out of the loudspeaker unit through the duct. The frame has an aperture that communicates with a space inside the frame. A link terminal is disposed near the edge of the aperture. The link terminal is connected to a lead wire extending from the voice coil. A wire harness connected to the link terminal is routed out of the aperture. The duct is attached at a first end thereof to the frame so as to cover the aperture.

In the loudspeaker unit with this configuration, since the frame, serving as an enclosure, has the aperture communicating with the space inside the frame and the duct, serving as a separate member, is attached to the frame so as to cover the aperture, the lead wire extending from the voice coil can be subjected to forming and be connected to the link terminal in a space within the aperture before attachment of the duct. Advantageously, routing of the lead wire can be easily achieved without any special use of an expensive damper provided with a lead wire.

In the above-described configuration, the frame may be a plastic molded component, the frame may include a support tab projecting into the aperture, and the link terminal may be attached to the support tab.

In the above-described configuration, the frame may include a protrusion having a notch such that the protrusion surrounds the aperture and the notch may serve as a path through which the wire harness is routed. In this configuration, when the duct is attached to the frame such that the first end of the duct is fitted onto the protrusion of the frame, the wire harness can be easily routed without being caught between the duct and the frame.

In the above-described configuration, the duct may have a recess at the first end thereof such that the link terminal is exposed in the recess and the wire harness may be connected to the link terminal in the recess. Advantageously, a connection status between the wire harness and the link terminal can be visibly checked in such a configuration.

In the above-described configuration, the frame may be disposed in a vehicle cabin of an automobile and the duct may communicate at a second end thereof with a space outside the vehicle cabin of the automobile. Such an arrangement facilitates communication of the duct of the loudspeaker unit with the space outside the vehicle cabin through an existing opening (e.g., a ventilation hole) in a body of the automobile. Advantageously, the loudspeaker unit can be used as, for example, an on-vehicle subwoofer which can be retrofitted to an existing vehicle and can be installed on various vehicles.

DETAILED DESCRIPTION OF THE PREFERRED EMBODIMENTS

Figure 1:
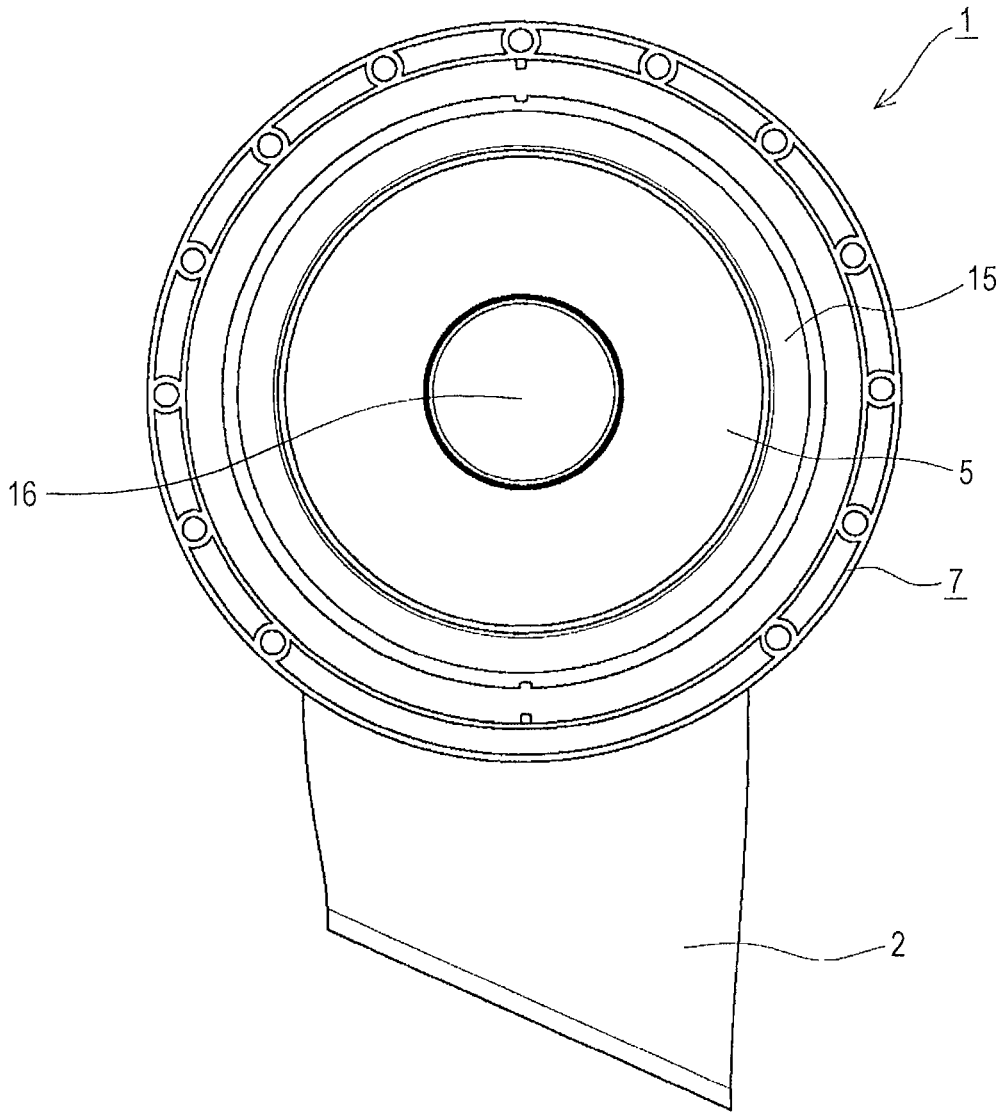
FIG. 1 is a front view of a loudspeaker unit according to an embodiment of the present invention.
Figure 2:
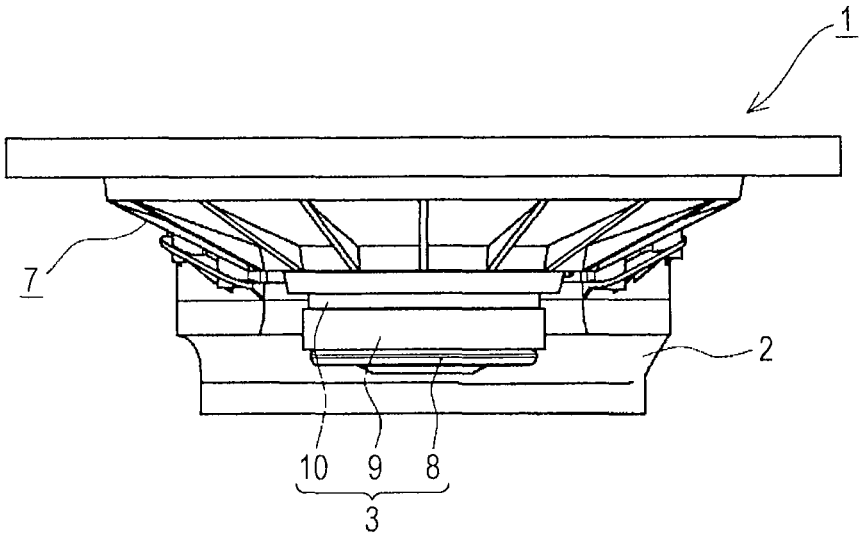
FIG. 2 is a top view of the loudspeaker unit.
Figure 3:
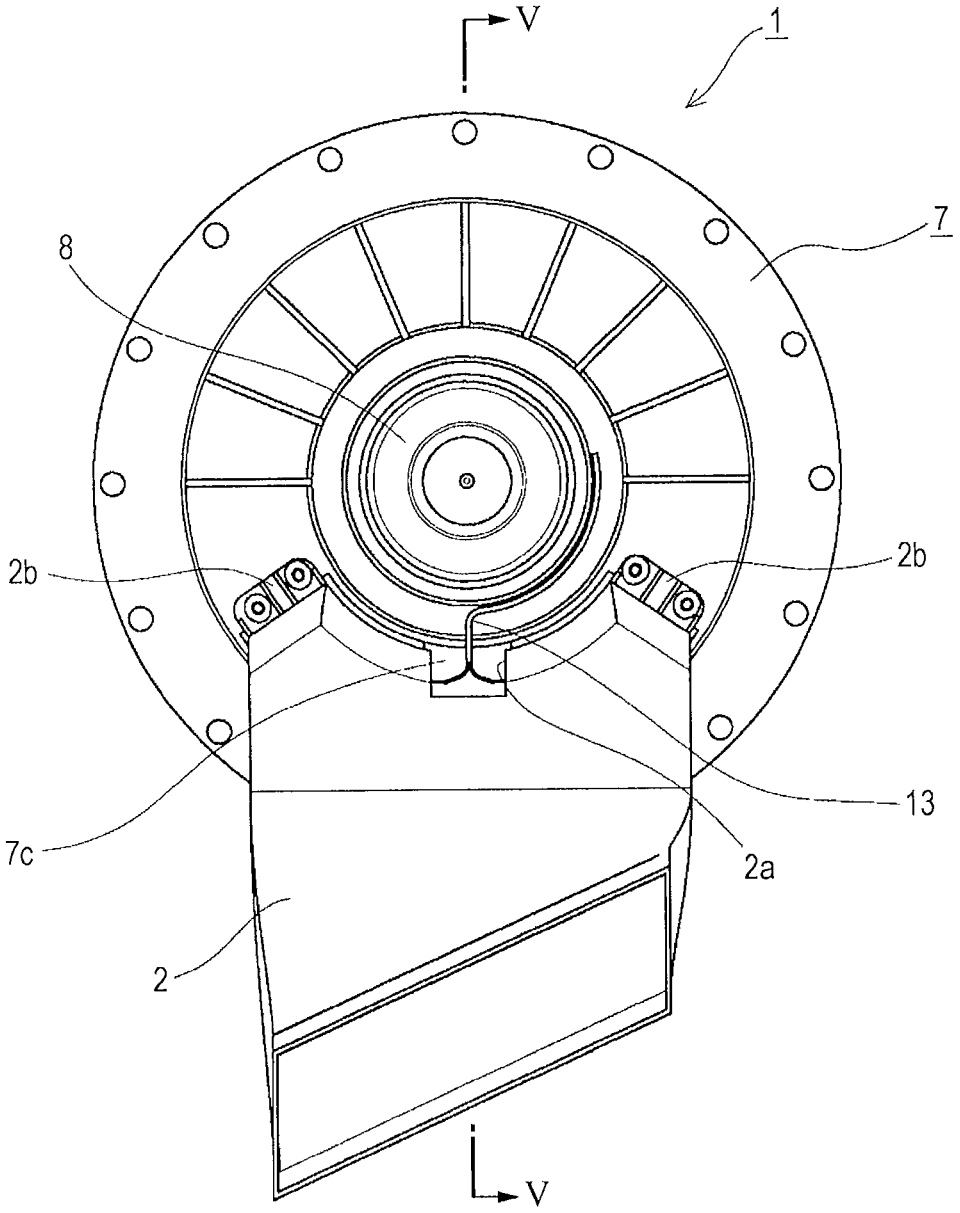
FIG. 3 is a rear view of the loudspeaker unit.
Figure 4:
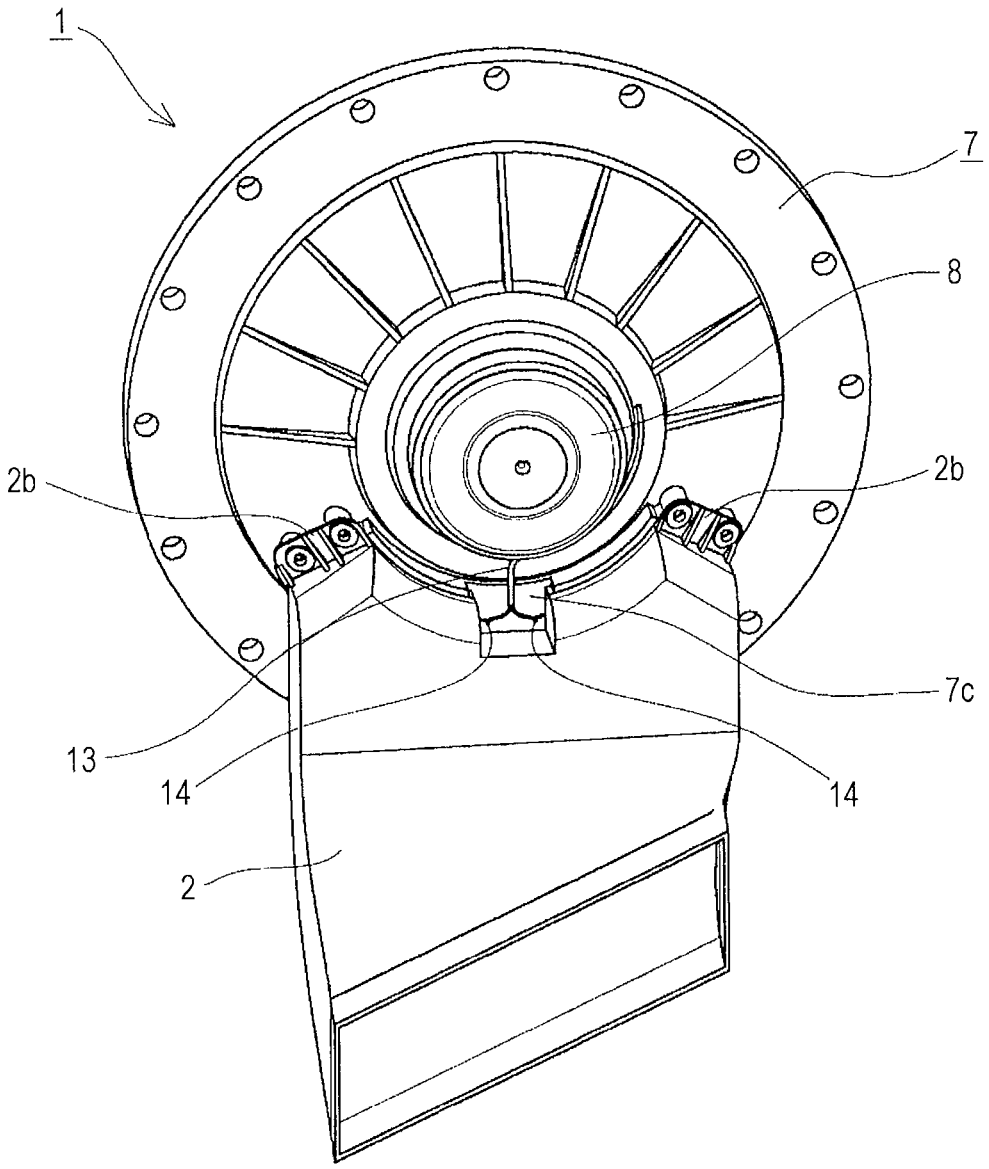
FIG. 4 is a perspective view of the loudspeaker unit.
Figure 5:
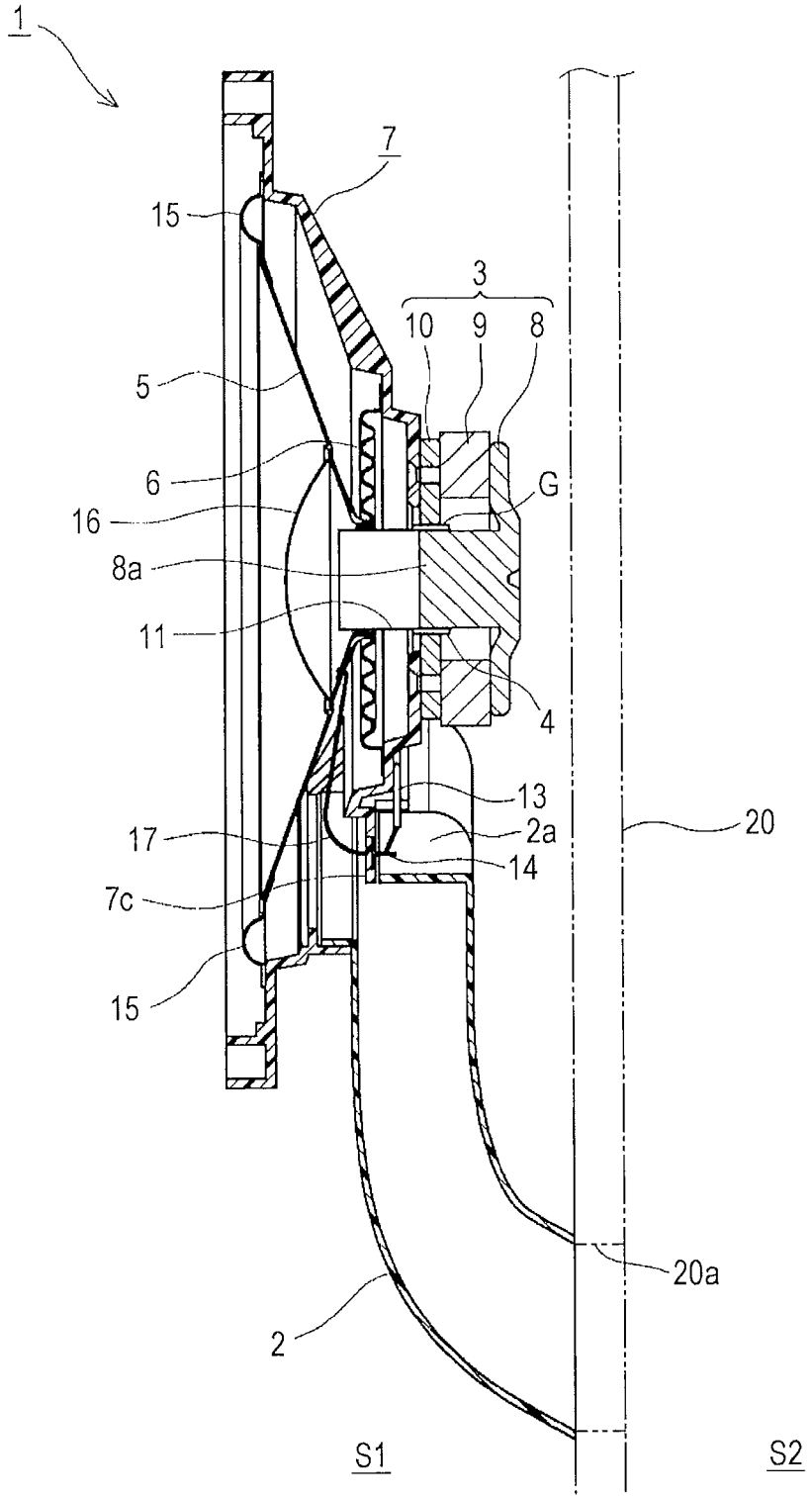
FIG. 5 is a cross-sectional view of the loudspeaker unit taken along the line V-V of FIG. 3.
Figure 6:
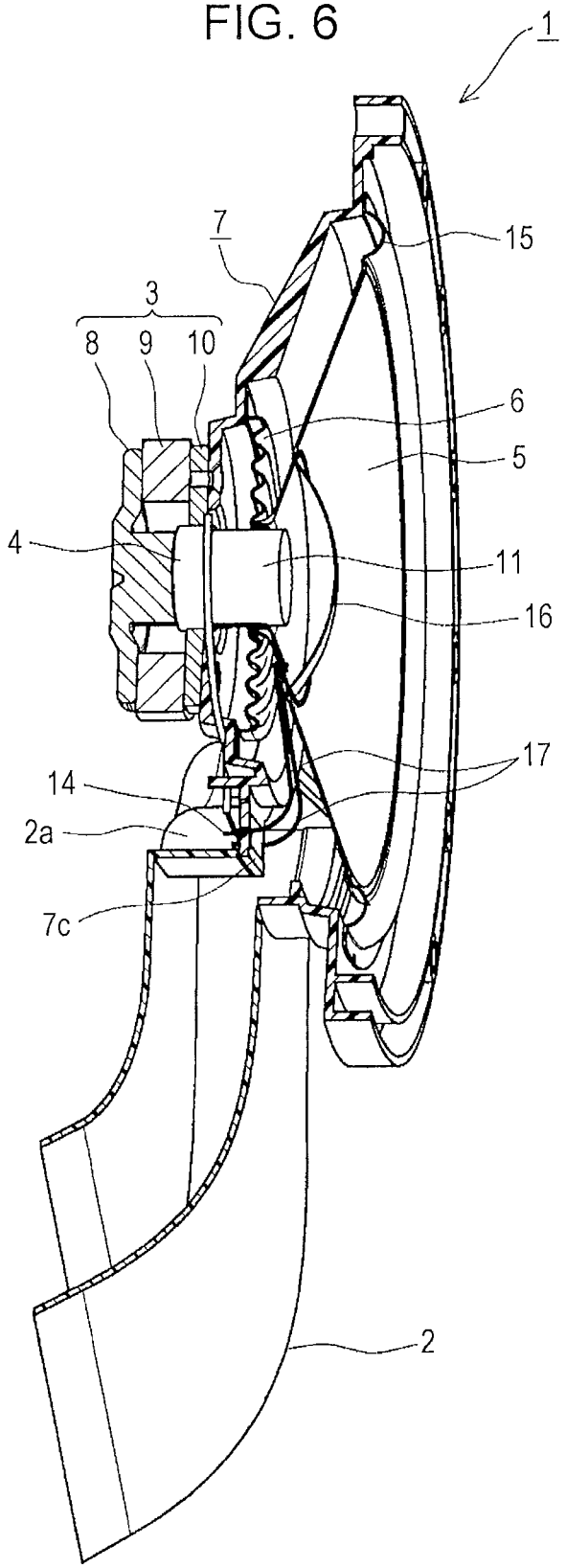
FIG. 6 is a perspective view illustrating a section of the loudspeaker unit taken along the line V-V of FIG. 3 as viewed from the side opposite to that of FIG. 5.

An embodiment of the present invention will be described below with reference to the drawings. As illustrated in FIG. 5, a loudspeaker unit 1 according to the embodiment of the present invention is a subwoofer installed in a vehicle cabin space S1 of an automobile and is provided with a duct 2 which communicates with an outside space S2 outside the vehicle cabin, for example, a space inside a bumper or an engine compartment. The vehicle cabin space S1 is separated from the outside space S2 by a partition 20 included in a body of the automobile. In this embodiment, a place where the duct 2 can communicate with the outside space S2 through an existing opening 20*a* in the partition 20 is selected as an installation place for the loudspeaker unit 1. For example, a ventilation hole is suitably used as the existing opening 20*a*. If there is no suitable existing opening, a new opening may be formed as the opening 20*a*.

The configuration of the loudspeaker unit 1 will be described below. As illustrated in FIGS. 1 to 6, the loudspeaker unit 1 includes a magnetic circuit 3 having a magnetic gap G, a voice coil 4 disposed in the magnetic gap G, the voice coil 4 being driven by electromagnetic interaction when energized, a substantially conical diaphragm 5 vibrating in unison with the voice coil 4, an annular damper 6 elastically supporting the voice coil 4 and the diaphragm 5, a substantially conical frame 7 holding an outer edge of the diaphragm 5 and an outer edge of the damper 6, and the duct 2 projecting from the frame 7.

The magnetic circuit 3 includes a bottom plate 8 having a center pole 8*a*, a ring-shaped magnet 9 placed on the bottom plate 8, and a top plate 10 disposed on the magnet 9. The magnetic gap G is defined between an outer circumferential surface of the center pole 8*a* and an inner circumferential surface of the top plate 10. The voice coil 4 is wound around a cylindrical bobbin 11. An inner edge of the diaphragm 5 and an inner edge of the damper 6 are bonded and fixed to upper end part of the bobbin 11.

Figure 7:
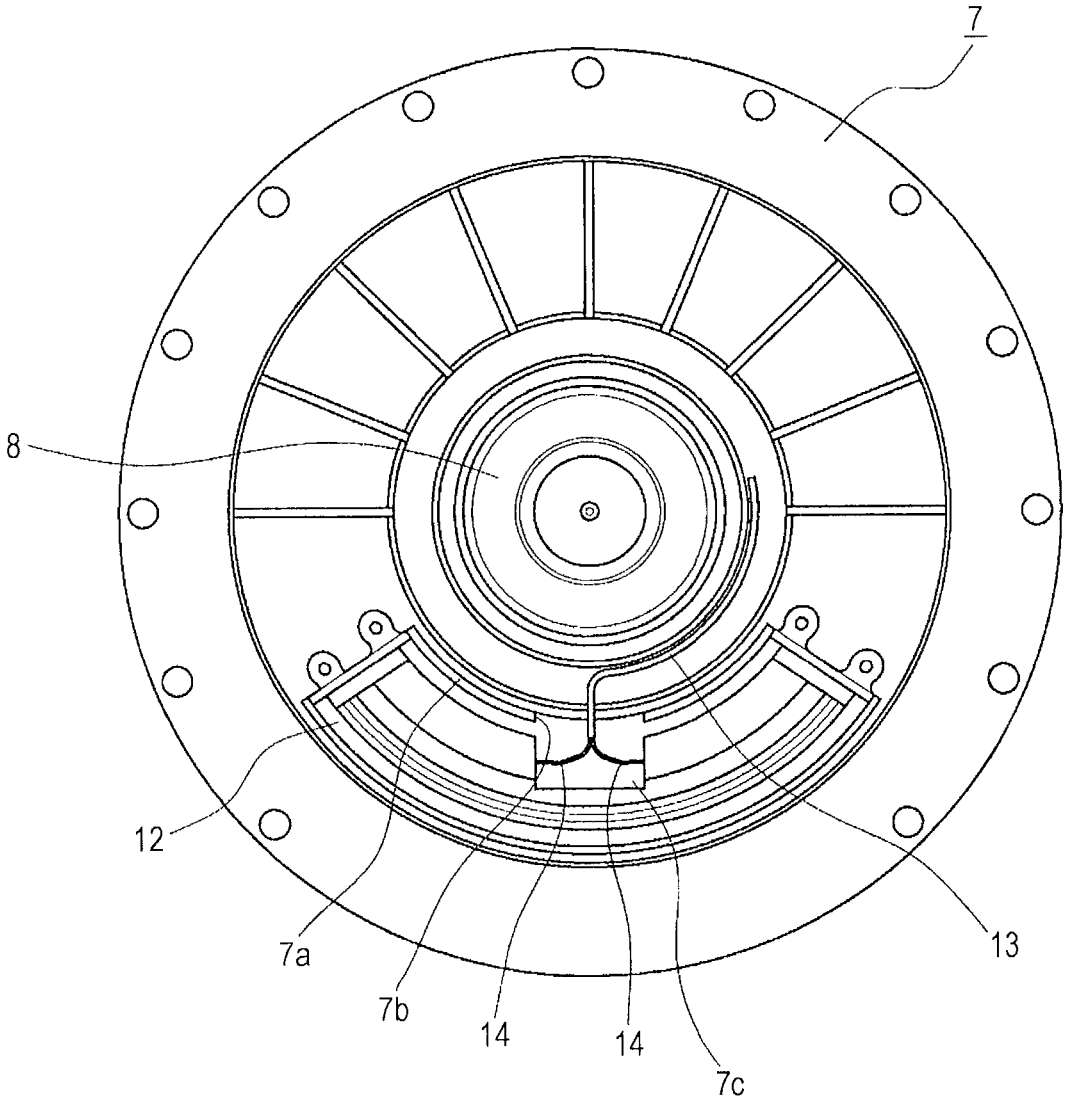
FIG. 7 is a rear view of the loudspeaker unit with a duct cut away.
Figure 8:
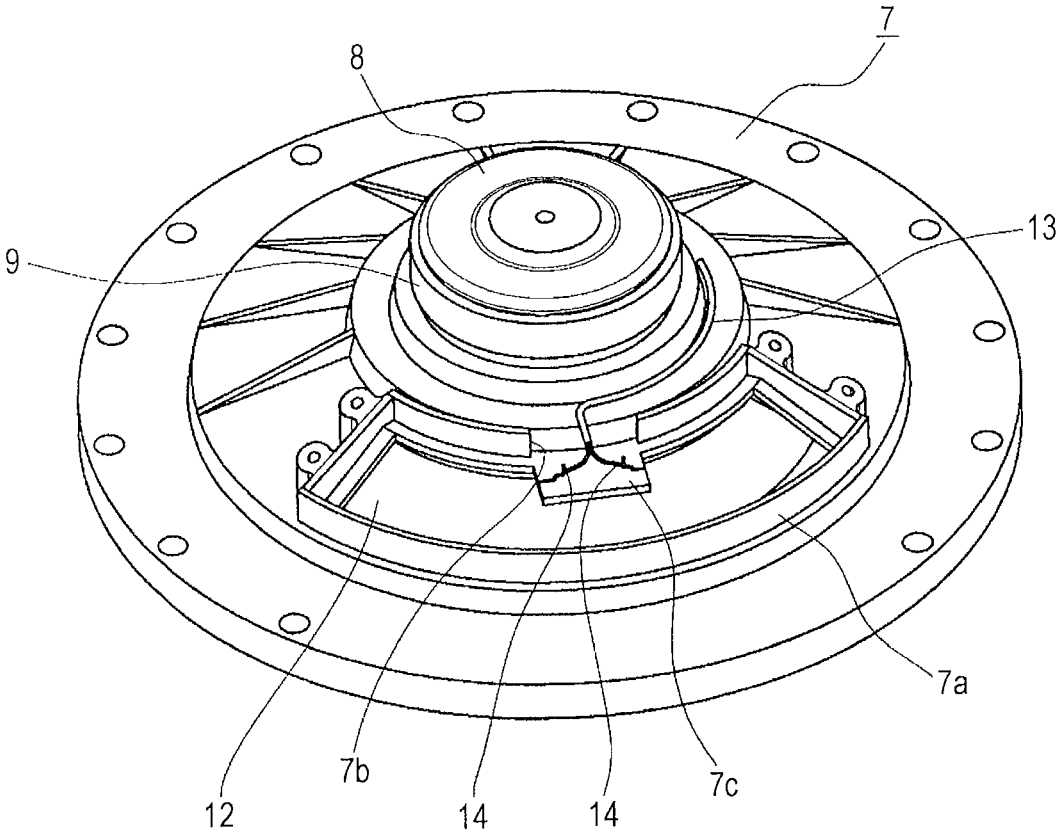
FIG. 8 is a perspective view of the loudspeaker unit with the duct cut away.
Figure 9:
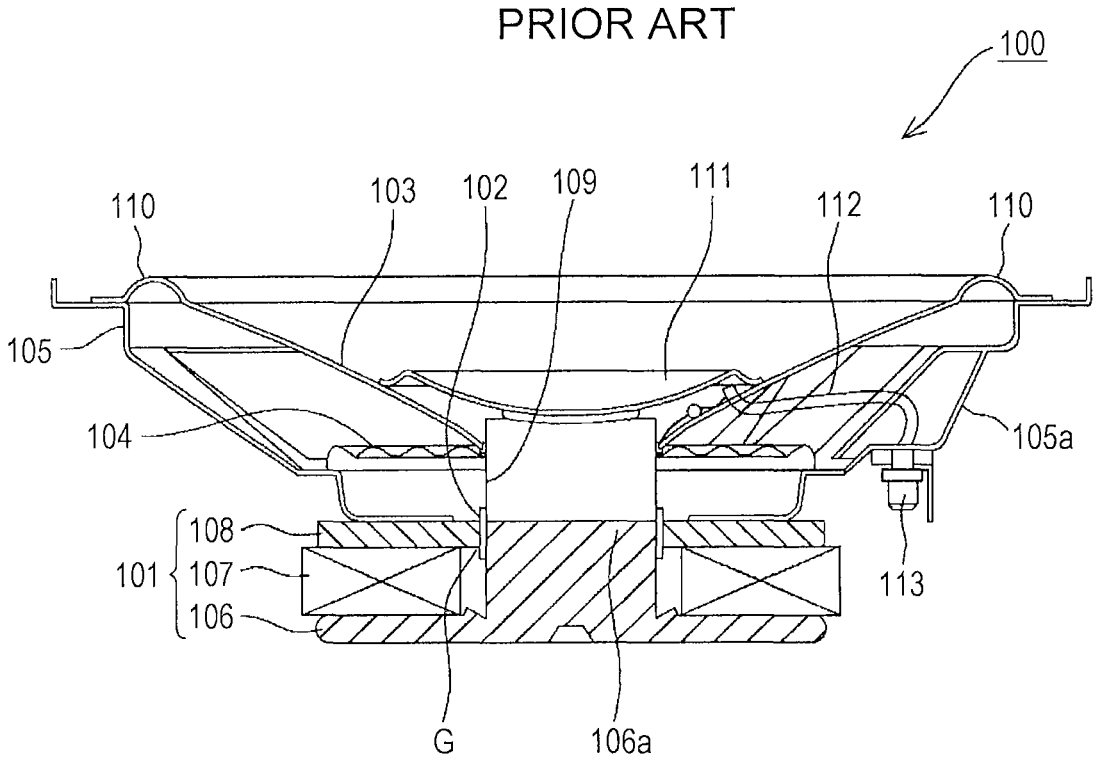
FIG. 9 PRIOR ART
FIG. 9 is a cross-sectional view of a related-art loudspeaker unit.

The frame 7 is a plastic molded component and has an aperture 12 in an outer surface thereof such that the aperture 12 extends arcuately in a circumferential direction. The outer surface of the frame 7 except the aperture 12 is closed. The aperture 12 communicates with an inner space defined between the frame 7 and the diaphragm 5. As illustrated in FIGS. 7 and 8, the frame 7 includes a protrusion 7*a* protruding so as to surround the aperture 12. The protrusion 7*a* has a notch 7*b*. The frame 7 includes a support tab 7*c* adjacent to the notch 7*b* such that the support tab 7*c* projects into the aperture 12. The notch 7*b* serves as a path through which a wire harness 13, which will be described later, is routed. A pair of link terminals 14 is attached to the support tab 7*c*. Each link terminal 14 is, for example, a metal pin. The link terminals 14 extend across the support tab 7*c* and are fixed to the support tab 7*c*. The frame 7 is fixed to an upper surface of the top plate 10 by means of screws, for example. The outer edge of the damper 6 is held by intermediate part of the frame 7. The outer edge of the diaphragm 5 is held by an upper end of the frame 7 with an edge member 15 therebetween. A cap 16 is attached to central part of the diaphragm 5. The outer edge of the damper 6 and an outer edge of the edge member 15 do not necessarily have to be directly fixed to the frame 7. The outer edge of the damper 6 and the outer edge of the edge member 15 may be fastened to a holding member (not illustrated), serving as a separate member, attached inside the frame 7 such that the damper 6 and the edge member 15 are indirectly held by the frame 7.

The duct 2 is a tubular plastic molded component having a rectangular cross-section. The duct 2 has a first end which is open and has substantially the same shape as that of the aperture 12. The duct 2 has a recess 2*a* at the first end such that the recess 2*a* corresponds to the support tab 7*c*. A pair of attachment lugs 2*b* extends outwardly from the first end of the duct 2. An inner surface of the first end of the duct 2 is fitted on an outer surface of the protrusion 7*a*, and the attachment lugs 2*b* are fixed to the outer surface of the frame 7 by means of screws or the like, such that the duct 2 is integrated with the frame 7 so as to cover the aperture 12. Although the duct 2 can be in direct tight contact with the frame 7, the duct 2 may be integrated with the frame 7 with a cushion (not illustrated) therebetween.

A pair of lead wires 17, called tinsel wires, is connected to the voice coil 4. The voice coil 4 is energized through the lead wires 17. The lead wires 17 are outwardly routed in a space between the diaphragm 5 and the damper 6 and are connected to the link terminals 14 attached to the support tab 7*c*. The connection of the lead wires 17 is performed in a state in which the aperture 12 is exposed, as illustrated in FIGS. 7 and 8, while the duct 2 is detached from the frame 7. Specifically, a jig (not illustrated) is inserted into the aperture 12, the lead wires 17 are formed into a predetermined shape (for example, a curved shape) using the jig, the tips of the lead wires 17 are welded to first ends of the link terminals 14 inside the support tab 7*c*, and the jig is then removed. Terminals of the wire harness 13 are welded to second ends of the link terminals 14 outside the support tab 7*c*, and the duct 2 is then attached to the frame 7 so as to cover the aperture 12, so that the link terminals 14 can be exposed in the recess 2*a* of the duct 2 and the wire harness 13 can be routed out of the aperture 12 through the notch 7*b*.

In the loudspeaker unit 1 with the above-described configuration, when audio current is supplied through the wire harness 13, the link terminals 14, and the lead wires 17 to the voice coil 4, the voice coil 4 is driven in the horizontal direction in FIG. 5 by the well-known electromagnetic interaction. Accordingly, the surrounding air is vibrated by the diaphragm 5 moving in unison with the voice coil 4, so that reproduced sound generated by the vibration is emitted from a front surface of the diaphragm 5 to the vehicle cabin space S1. Although the air is vibrated on the rear side of the diaphragm 5 in a space within the frame 7 which serves as an enclosure at this time, back pressure is not excessively increased during vibration of the diaphragm 5 because the space on the rear side of the diaphragm 5 communicates with the outside space S2 through the duct 2. Accordingly, the loudspeaker unit 1 can be used as a subwoofer for increasing sound pressure in a low frequency range of 30 to 100 Hz.

As described above, the loudspeaker unit 1 according to this embodiment is configured such that the frame 7 holding the outer edge of the diaphragm 5 and the outer edge of the damper 6 has the aperture 12 which communicates with the space inside the frame 7 and the duct 2, serving as a separate component, is attached to the frame 7 so as to cover the aperture 12. Accordingly, the lead wires 17 extending from the voice coil 4 can be subjected to forming and be connected to the link terminals 14 in the space within the aperture 12 before the duct 2 is attached to the frame 7. Advantageously, routing of the lead wires 17 can be easily achieved without any special use of an expensive damper provided with lead wires.

In the loudspeaker unit 1 according to this embodiment, since the frame 7, molded in one-piece of plastic, includes the support tab 7*c* projecting into the aperture 12 and the wire harness 13 and the lead wires 17 are connected to the link terminals 14 attached to the support tab 7*c*, the link terminals 14 can be easily attached to the frame 7 which serves as an enclosure.

In the loudspeaker unit 1 according to this embodiment, since the protrusion 7*a* having the notch 7*b* protrudes so as to surround the aperture 12 and the wire harness 13 connected to the link terminals 14 is routed outwardly through the notch 7*b*, the wire harness 13 can be easily routed without being caught between the duct 2 and the frame 7 when the duct 2 is attached to the frame 7 such that the first end of the duct 2 is fitted on the protrusion 7*a* of the frame 7. Additionally, this prevents the wire harness 13 from being damaged.

In the loudspeaker unit 1 according to this embodiment, since the duct 2 has the recess 2*a* at the first end thereof such that the link terminals 14 are exposed in the recess 2*a* and the wire harness 13 is connected to the link terminals 14 in the recess 2*a*, a connection status between the wire harness 13 and the link terminals 14 can be easily visibly checked.

Although the embodiment has been described with respect to the case where the frame 7 includes the support tab 7*c* projecting into the aperture 12 and the link terminals 14 are attached to the support tab 7*c*, the support tab 7*c* may be omitted and the link terminals 14 may be attached near the edge of the aperture 12. In this case, an assembly operator can insert a jig (not illustrated) into the aperture 12, form the lead wires 17 into a predetermined shape, weld the tips of the lead wires 17 to the first ends of the link terminals 14 inside the frame 7, and then remove the jig. In other words, the link terminals 14 may be attached at any position either inside (or in an area surrounded by) or outside the edge of the aperture 12 such that the link terminals 14 are arranged near the edge of the aperture 12, so long as the assembly operator can insert his or her finger or fingers into the aperture 12, form the lead wires 17 into a predetermined shape using the jig, and connect the tips of the lead wires 17, formed in the predetermined shape, to the link terminals 14 inside the frame 7 by welding or the like.

Although the embodiment has been described with respect to the case where the loudspeaker unit 1 is the subwoofer installed in the vehicle cabin, the invention is not limited to an on-vehicle subwoofer. The invention is applicable to any other loudspeakers configured such that the frame 7 supporting loudspeaker components is disposed in an acoustic space and the duct 2 is allowed to communicate with an outside space.

Although the embodiment has been described with respect to the case where the loudspeaker unit 1 is installed in the vehicle cabin space S1 and the duct 2 is allowed to communicate with the outside space, the loudspeaker unit 1 can be installed in the outside space S2, such as a space inside the bumper or the engine compartment, such that reproduced sound generated by vibration of the diaphragm 5 is emitted through the duct 2 into the vehicle cabin space S1.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A loudspeaker unit comprising:

a magnetic circuit having a magnetic gap;

a voice coil disposed in the magnetic gap; a diaphragm vibrating in unison with the voice coil; a damper elastically supporting the voice coil and the diaphragm; a frame holding an outer edge of the diaphragm and an outer edge of the damper; and a duct projecting from the frame, with air moved by vibration of the diaphragm flowing into and out of the loudspeaker unit through the duct, wherein the frame serving as an enclosure is closed except for an aperture that communicates with a space inside the frame, a link terminal is disposed near the edge of the aperture, the link terminal is connected to a lead wire extending from the voice coil, a wire harness connected to the link terminal is routed out of the aperture, and the duct is attached at a first end thereof to the frame so as to cover the aperture while exposing the link terminal outside of the duct;

wherein the link terminal extends through the frame and is fixed to the frame, and the link terminal is connected at a first end thereof to the lead wire and is connected at a second end thereof to the wire harness; and wherein the aperture is sized and configured to receive a jig for forming the lead wire in to a predetermined shape.

2. The loudspeaker unit according to claim 1, wherein the frame is a plastic molded component, the frame includes a support tab that projects into the aperture, and the link terminal is attached to the support tab.

3. The loudspeaker unit according to claim 1, wherein the frame includes a protrusion having a notch such that the protrusion surrounds the aperture, and the notch serves as a path through which the wire harness is routed.

4. The loudspeaker unit according to claim 1, wherein the duct has a recess at the first end thereof such that the link terminal is exposed in the recess, and the wire harness is connected to the link terminal in the recess.

5. The loudspeaker unit according to claim 1, wherein the frame is disposed in a vehicle cabin of an automobile, and the duct communicates at a second end thereof with a space outside the vehicle cabin of the automobile.

6. A loudspeaker unit comprising:

a magnetic circuit having a magnetic gap;

a voice coil disposed in the magnetic gap;

a diaphragm secured at an inner edge to the voice coil and vibrating in unison with the voice coil;

a frame holding an outer edge of the diaphragm and enclosing a face of the diaphragm, wherein the frame serving as an enclosure is closed except for an aperture that communicates with a space inside the frame, the frame is a plastic molded component, the frame includes a support tab that projects into the aperture, and a link terminal is attached to the support tab; and a duct attached at a first end thereof to the frame so as to cover the aperture and project from the frame, with air moved by vibration of the diaphragm flowing into and out of the loudspeaker unit through the duct, wherein a lead wire extends from the voice coil;

wherein the duct has a recess at the first end thereof such that the link terminal is exposed outside of the duct in the recess;

wherein the link terminal extends through the frame and is fixed to the frame, and the link terminal is connected at a first end thereof to the lead wire and is connected at a second end thereof to a wire harness; and wherein the aperture is sized and configured to receive a jig for forming the lead wire in to a predetermined shape.

7. The loudspeaker unit according to claim 6, wherein the frame includes a protrusion having a notch such that the protrusion surrounds the aperture, and the notch serves as a path through which the wire harness is routed.

8. The loudspeaker unit according to claim 6, wherein the frame is disposed in a vehicle cabin of an automobile, and the duct communicates at a second end thereof with a space outside the vehicle cabin of the automobile.

9. A loudspeaker unit comprising:

a magnetic circuit having a magnetic gap;

a voice coil disposed in the magnetic gap;

a diaphragm vibrating in unison with the voice coil;

a damper elastically supporting the voice coil and the diaphragm;

a frame holding an outer edge of the diaphragm and an outer edge of the damper; and a duct projecting from the frame, with air moved by vibration of the diaphragm flowing into and out of the loudspeaker unit through the duct, wherein the frame serving as an enclosure is closed except for an aperture that communicates with a space inside the frame, a link terminal is disposed near the edge of the aperture, the link terminal is connected at a first end to a lead wire extending from the voice coil and is connected at a second end to a wire harness, and the duct is attached at a first end thereof to the frame so as to cover the aperture while exposing the link terminal outside of the duct;

wherein the frame includes a protrusion having a notch such that the protrusion surrounds the aperture, and the notch serves as a path through which the wire harness is routed; and wherein the aperture is sized and configured to receive a jig for forming the lead wire into a predetermined shape.

10. The loudspeaker unit according to claim 9, wherein the frame is a plastic molded component, the frame includes a support tab that projects into the aperture, and the link terminal is attached to the support tab.

11. The loudspeaker unit according to claim 9, wherein the duct has a recess at the first end thereof such that the link terminal is exposed in the recess, and the wire harness is connected to the link terminal in the recess.

12. The loudspeaker unit according to claim 9, wherein the link terminal extends through the frame and is fixed to the frame; and wherein the frame is disposed in a vehicle cabin of an automobile, and the duct communicates at a second end thereof with a space outside the vehicle cabin of the automobile.

* * * * *